US006564855B2

(12) United States Patent
Salata

(10) Patent No.: US 6,564,855 B2
(45) Date of Patent: May 20, 2003

(54) INTERCHANGEABLE DIE FOR A DIE CASTING MACHINE AND METHOD

(76) Inventor: Zoltan P. Salata, 7616 Florence Ave., Downers Grove, IL (US) 60516

( * ) Notice: Subject to any disclaimer, the term of this patent is extended or adjusted under 35 U.S.C. 154(b) by 0 days.

(21) Appl. No.: 10/200,369

(22) Filed: Jul. 22, 2002

(65) Prior Publication Data

US 2002/0179274 A1 Dec. 5, 2002

Related U.S. Application Data

(62) Division of application No. 09/808,444, filed on Mar. 14, 2001, now Pat. No. 6,422,297.

(60) Provisional application No. 60/189,590, filed on Mar. 15, 2000.

(51) Int. Cl.[7] ..... B22D 17/10; B22D 17/26

(52) U.S. Cl. ..... 164/113; 164/137

(58) Field of Search ..... 164/137, 339, 164/341, 342, 113, 312

(56) References Cited

U.S. PATENT DOCUMENTS

| | | | |
|---|---|---|---|
| 3,733,161 | A | 5/1973 | Nussbaum |
| 4,009,979 | A | 3/1977 | Martin |
| 4,158,910 | A | 6/1979 | Hanas et al. |
| 4,202,522 | A | 5/1980 | Hanas et al. |
| 4,348,165 | A | 9/1982 | Vostrovsky |
| 4,416,604 | A | 11/1983 | Bender et al. |
| 4,472,127 | A | 9/1984 | Cyriax et al. |
| 4,500,274 | A | 2/1985 | Cyriax et al. |
| 4,500,275 | A | 2/1985 | Ruhl |
| 4,714,421 | A | 12/1987 | D'Agostino |
| 4,776,783 | A | 10/1988 | Pelle et al. |
| 4,786,244 | A | 11/1988 | Holzschuh |
| 4,793,785 | A | 12/1988 | Osada |
| 4,805,285 | A | 2/1989 | Reyes |
| 4,861,254 | A | 8/1989 | Takeuchi et al. |
| 4,867,668 | A | 9/1989 | Miyairi |
| 4,872,827 | A | 10/1989 | Noda |
| 4,888,252 | A | 12/1989 | Kilim |
| 4,929,166 | A | 5/1990 | DiSimone et al. |
| 5,012,568 | A | 5/1991 | DiSimone et al. |
| 5,022,784 | A | 6/1991 | DeVries et al. |
| 5,033,784 | A | 7/1991 | Martin |
| 5,096,404 | A | 3/1992 | Janos et al. |
| 5,350,289 | A | 9/1994 | Martin |
| 5,562,935 | A | 10/1996 | Martin |

FOREIGN PATENT DOCUMENTS

| | | |
|---|---|---|
| JP | 176346 | 2/1987 |
| JP | 240050 | 5/1987 |

OTHER PUBLICATIONS

Drawings, "Moule Plastique Pour Exposition", 7 pages, Apr. 24, 1997.

Advertisement, Die Casting Engineering, 1 page, Sep., 2001.

*Primary Examiner*—Kuang Y. Lin
(74) *Attorney, Agent, or Firm*—Marshall, Gerstein & Borun

(57) ABSTRACT

An interchangeable die system in accordance with the present invention may include two main parts: a shank and a die assembly. The shank is a structural frame that is secured to and remains attached to the die casting machine during a change of the die assembly. The die assembly consists of a die, an adaptor plate and an ejector plate assembly. The die assembly is secured to the shank using the adaptor plate and a locking cam. A spool assembly slides within the shank to actuate the ejector plate assembly.

12 Claims, 11 Drawing Sheets

INTERCHANGEABLE DIE FOR A DIE CASTING MACHINE AND METHOD

CROSS-REFERENCE TO RELATED APPLICATION

This application is a divisional application of U.S. application Ser. No. 09/808,444, filed Mar. 14, 2001 now U.S. Pat. No. 6,422,297, the disclosure of which is hereby expressly incorporated herein by reference.

This application claims priority to U.S. provisional patent application Serial No. 60/189,590, entitled "Interchangeable Die for a Die Casting Machine and Method," filed Mar. 15, 2000, the disclosure of which is hereby expressly incorporated herein by reference.

BACKGROUND OF THE INVENTION

1. Field of the Invention

The invention relates generally to die casting, and more particularly, the invention relates to interchangeable dies for a die casting machine.

2. Description of the Related Art

An injection molding machine or die casting machine operates at a high speed to produce hundreds of die cast products per hour. Between the production of two different die cast products, the die for forming one part must be removed from the die casting machine and a new die must be inserted into the casting machine to form the new part. Because each die casting machine is a complex mechanical assembly including such parts as lock-out pins, ejector pins, slides, pulls, coolant lines and removable dies or molds to create the desired shapes, it is labor intensive and time consuming to disassemble the machine to change the die. Typically, each die has accessory components such as those previously mentioned that must be detached, reattached and/or appropriately adjusted to accommodate each new die. In addition, a die consists of two or more portions that when closed together define a cavity into which the die cast material, such as zinc, is injected. Each die portion is typically coupled to a shank that serves as a structural frame and connects the die portion to a toggle mechanism of the die casting machine. Because the die portion is secured to the shank, typically by machine screws that extend longitudinally through the shank and engage a rear surface of the die portion, the shank and die portion must be removed together from the die casting machine when changing dies. With current die casting machines and die designs, skilled technicians may spend hours disassembling the machine to remove and reinsert a new die.

As can be appreciated from the foregoing discussion, changing a die in current die casting machines is very time-consuming and may often take as long as several hours. While the dies are changed, the machine recalibrated and the accessories reconnected to conform to a new die, the machine sits idle wasting valuable production time. This idle time is undesirable because it affects the profitability of the machine, e.g. a long downtime to change dies means less parts are produced and thus less profit to the company. So, to maximize the productivity of each die casting machine, the time required to change the die must be reduced. With such a reduction in change time, consumers will benefit because manufacturing costs will decrease and ultimately be passed to the consumer in the form of less expensive products in the stores.

There have been attempts to increase the speed at which dies are changed. In U.S. Pat. No. 5,350,289, a quick change system is disclosed that has a mold base including an ear plate for attachment to the back half of the mold base and an adaptor frame including a pair of U-shaped guide channels for receiving and supporting the ear plate. T-shaped guide rollers are mounted in line with each side of the guide channel to capture the ear plate and keep the ear plate in line with the adaptor frame. While the guide rails and corresponding rollers ease the transferability of the molds, the addition of parts makes the fabrication of the machine assembly more complex and may, therefore, increase manufacturing costs.

In U.S. Pat. No. 5,562,935, an injection molding machine having a multi-port apparatus for connecting multiple coolant lines to a mold during installation is disclosed. While such an apparatus and its corresponding coolant lines may decrease the amount of time required to change the mold base, the multi-port apparatus also increases the complexity of the injection molding machine and may, therefore, complicate die changing and thereby increase manufacturing costs.

Thus, there is a need for an interchangeable die for a die casting machine and a method for changing dies in a die casting machine that reduces the time and labor required to make a die change.

SUMMARY OF THE INVENTION

In accordance with a preferred embodiment of the invention, a "Quick-Change" die provides an interchangeable die that allows the die or die assembly including the die and its corresponding attachments to be removed from the die casting machine independent of the shank which remains coupled to the casting machine. The interchangeable die construction greatly reduces the amount of time skilled technicians must spend changing dies and overcomes other disadvantages associated with the prior art by eliminating the necessity to disassemble other portions of the die casting machine not directly related to the die itself, such as sensors, coolant lines, mechanical connectors and the like, that are attached to the shank.

In accordance with a further preferred embodiment of the invention, a method, in conjunction with an interchangeable die design, is provided for facilitating the insertion and removal of various dies from a die casting machine.

An interchangeable die system in accordance with the present invention may include two main parts: a shank and a die assembly. The shank is a structural frame that is secured to and remains attached to the die casting machine during a change of the die. The die assembly consists of a die, an adaptor plate and an ejector plate. The die assembly is secured to the shank using the adaptor plate and a locking cam. A spool assembly slides within the shank to actuate the ejector plate assembly. The ejector plate assembly, located within the cavity of the shank, is engaged by the spool assembly.

BRIEF DESCRIPTION OF THE DRAWINGS

The many advantages and features of the present invention will be appreciated from the following detailed description of several preferred embodiments with reference to the attached drawings wherein like reference numerals are used to represent like elements, and in which.

DETAILED DESCRIPTION OF THE PREFERRED EMBODIMENTS

Figure 1:
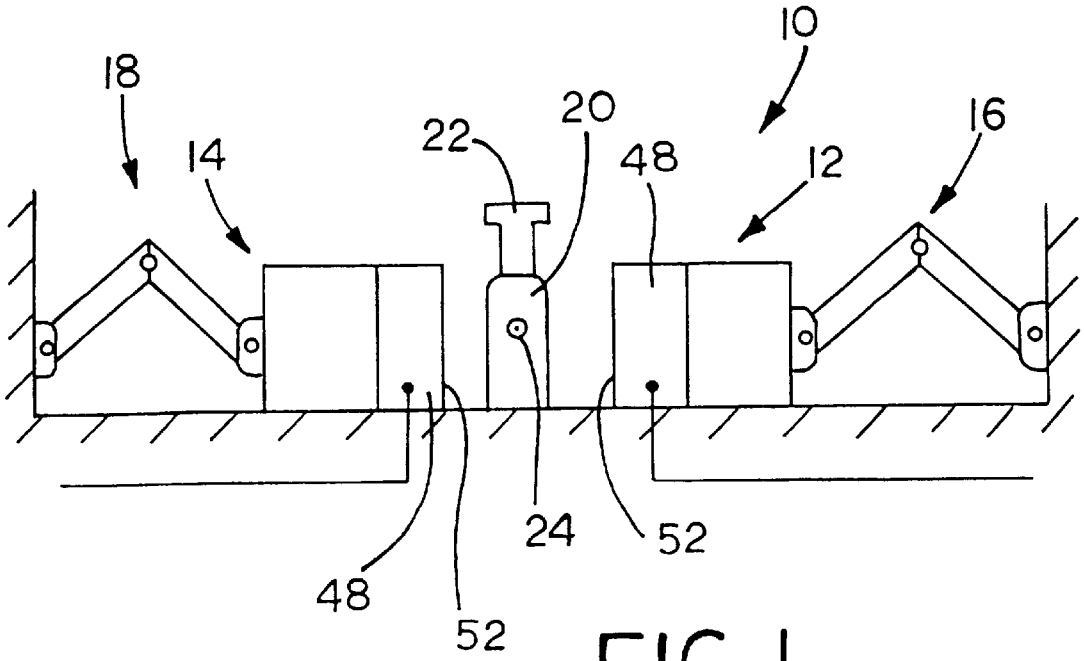
FIG. 1 is a schematic illustration of a die casting machine adapted in accordance with a preferred embodiment of the present invention.

Referring to FIG. 1, there is illustrated schematically a die casting machine 10. The die casting machine 10 includes interchangeable die systems 12 and 14 coupled to corresponding toggle mechanisms 16 and 18 of the die casting machine 10. The toggle mechanisms 16 and 18 operate in conjunction with one or more prime mover (not depicted) as is well known in the art for relatively translating the interchangeable die systems 12 and 14 for forming a mold chamber (not depicted). The die casting machine 10 includes a source of raw material, such as molten zinc, coupled to a gooseneck 20. The gooseneck 20 is coupled to introduce the raw material into the closed die systems 12 and 14, and a plunger 22, operates within the gooseneck 20 to communicate the raw material under pressure into the mold chamber. The raw material is ejected from the gooseneck 20 into the mold chamber through a nozzle 24.

Figure 2:
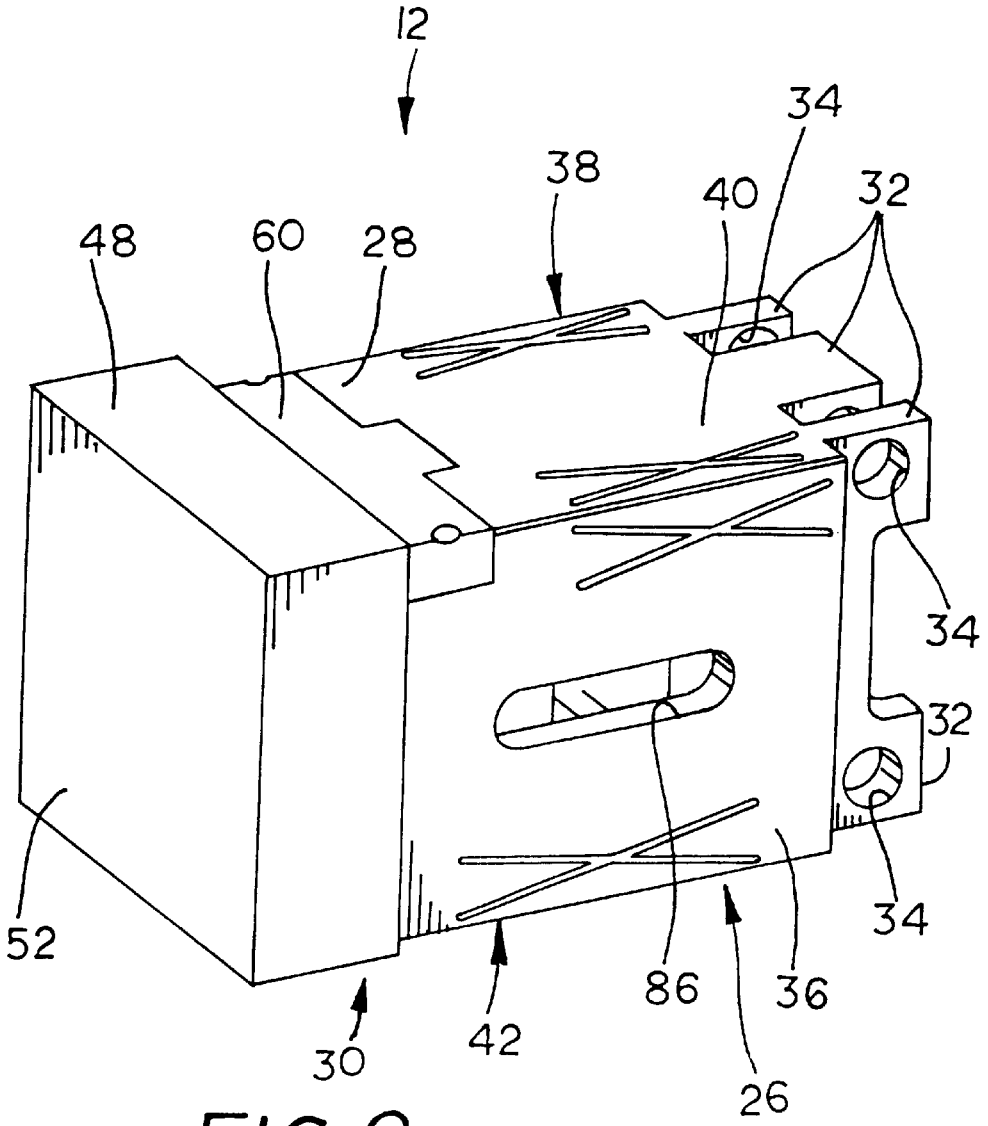
FIG. 2 is a perspective view of a die assembly in accordance with a preferred embodiment of the present invention.

Referring to FIG. 2, each "Quick-Change" or interchangeable die system 12 and 14 in accordance with a preferred embodiment of the invention includes a shank 26 and a die assembly 30. At least two and as many as six interchangeable die systems can be secured to a die casting machine for casting a part. The shank 26 includes a rectangular, structural frame 28 that is secured to and remains attached to the toggle mechanisms 16 and 18 of the die casting machine 10 during the die change. In this regard, the shank 26 includes flanges 32 formed with attachment apertures 34 through which compression nuts and spacers are used to pivotally connect the shank 26 with compression lever brackets of the toggle mechanisms 16 and 18.

Figure 3:
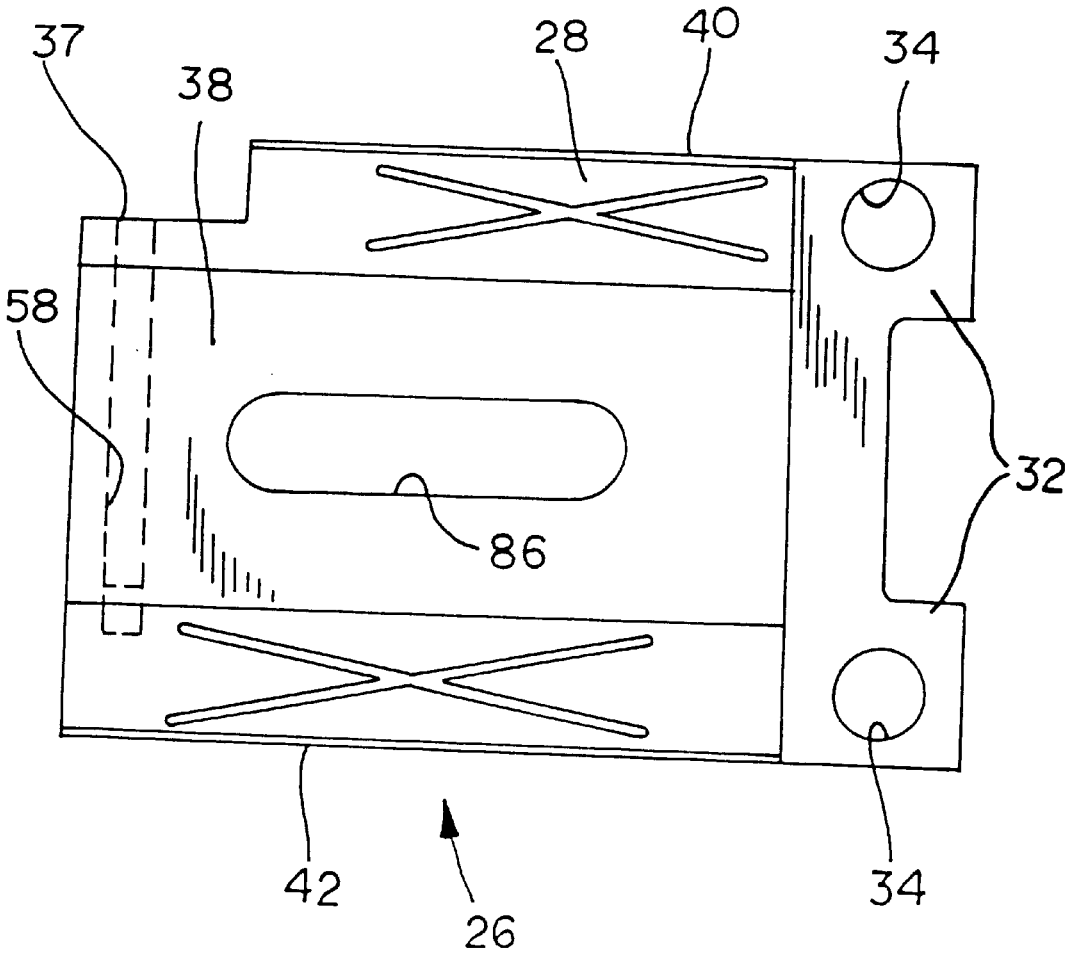
FIG. 3 is a front elevation view of a shank adapted in accordance with a preferred embodiment of the invention.
Figure 4:
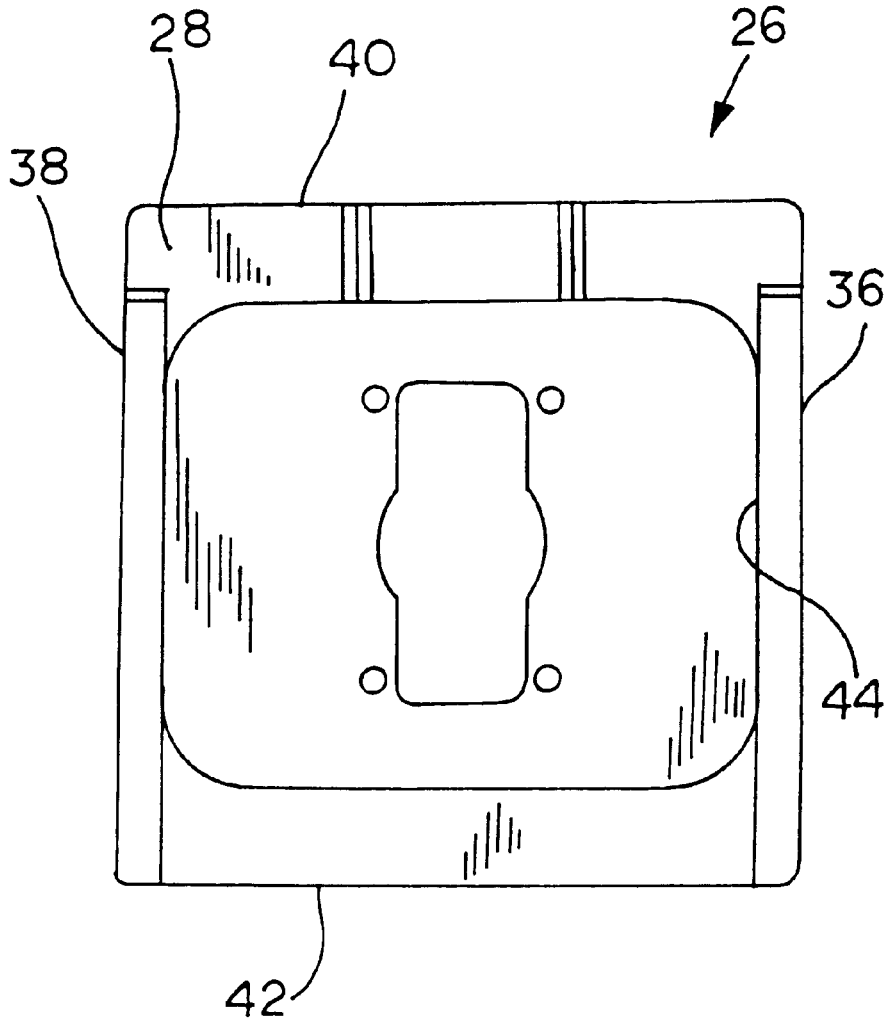
FIG. 4 is a side view of the shank illustrated in FIG. 3.

With continued reference to FIG. 2 and reference also to FIGS. 3 and 4, the structural frame 28 has a front face 36, rear face 38, top face 40 and bottom face 42 forming a cavity 44 in which the die assembly 30 and a spool assembly 46 are positioned. Otherwise, the shank 26 is of conventional construction. The front face 36 and the rear face 38 may be used interchangeably depending on the orientation of the die assembly 30 in the die casting machine 10. It should be appreciated that in alternate embodiments of the invention the shank may take other shapes, which permit the shank 26 to remain coupled to the toggle mechanisms 16 and 18 of the die casting machine 10 throughout the die changing operation.

Figure 5:
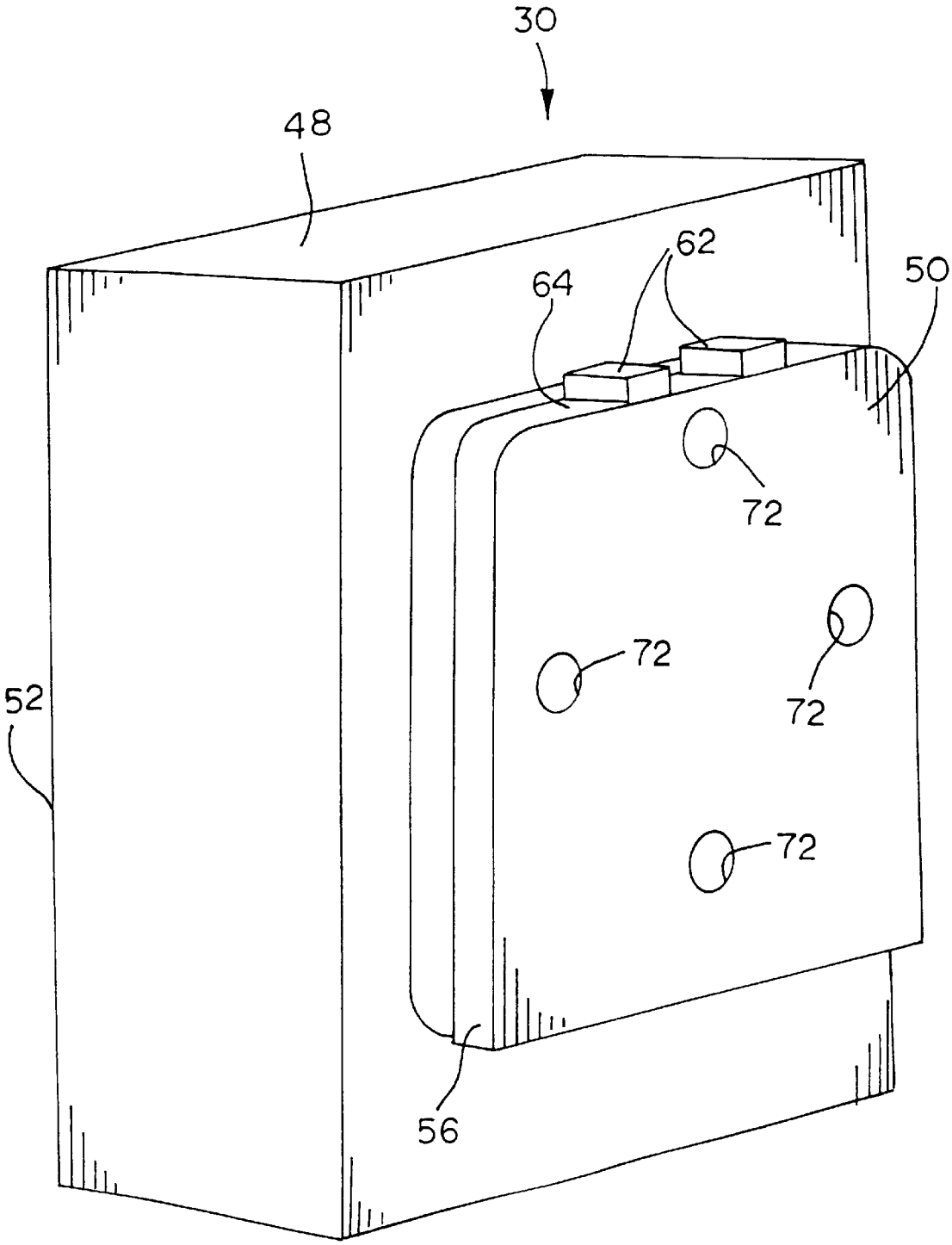
FIG. 5 is perspective view of a die assembly in accordance with a preferred embodiment of the present invention.
Figure 6:
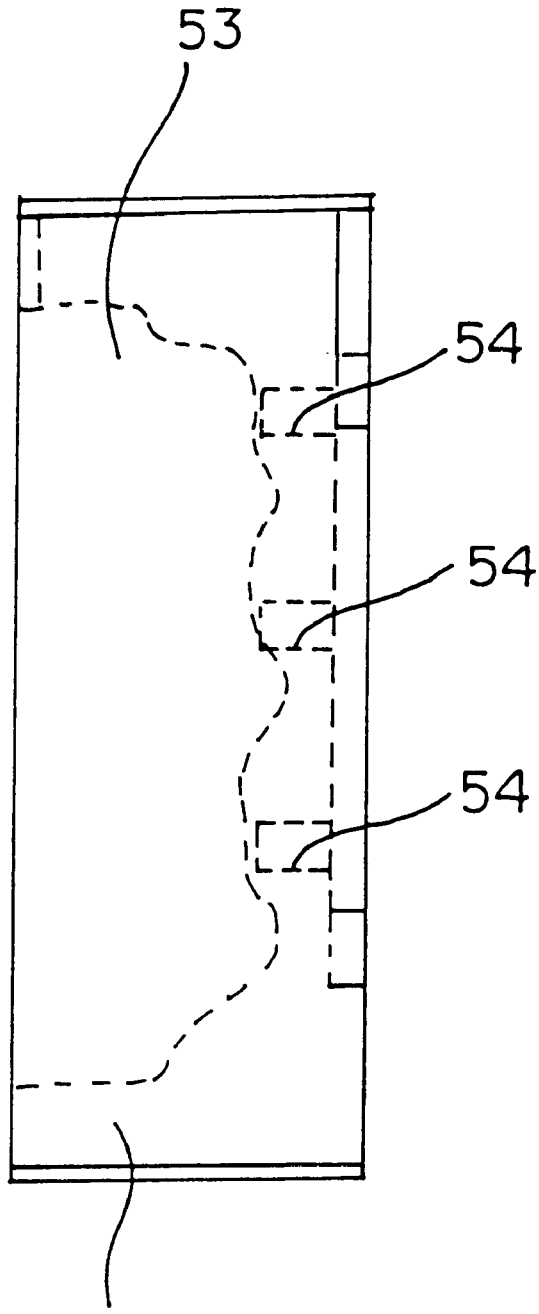
FIG. 6 is a front elevation view of a die in accordance with a preferred embodiment of the present invention.

As shown in FIG. 1 and FIG. 5, each die assembly 30 includes a die member 48 to which there is secured an adaptor plate 50. Each die member 48 includes a die face 52 into which is formed a mold portion 53 to produce one or more precision zinc injection products. As depicted in FIG. 6, the mold portion 53 is represented by the phantom line. When the mold portion 53 of each die 48 in the machine 10 is brought together by the toggle mechanisms 16 and 18 of the die casting machine 10, the mold portions form a complete mold defining the shape of the die cast product being manufactured as well as the associated sprues, vents and the like, as is well known in the art. As described above, the mold chamber is filled with raw material, such as molten zinc metal, to produce the die cast product. During the manufacturing process, the die is cooled by a water based fluid which circulates through the die 48 as is well known.

In accordance with the preferred embodiments of the invention, the die assembly 30 is interchangeable, that is, it may be removed from the die casting machine 10 independent of the shank 26, which remains coupled to the die casting machine 10. With continued reference to FIG. 5, as described, an adaptor plate 50 is secured to the die 48, for example, by the engagement of threaded fasteners (not shown) with blind threaded apertures (not shown) formed in the die 48.

Figure 8:
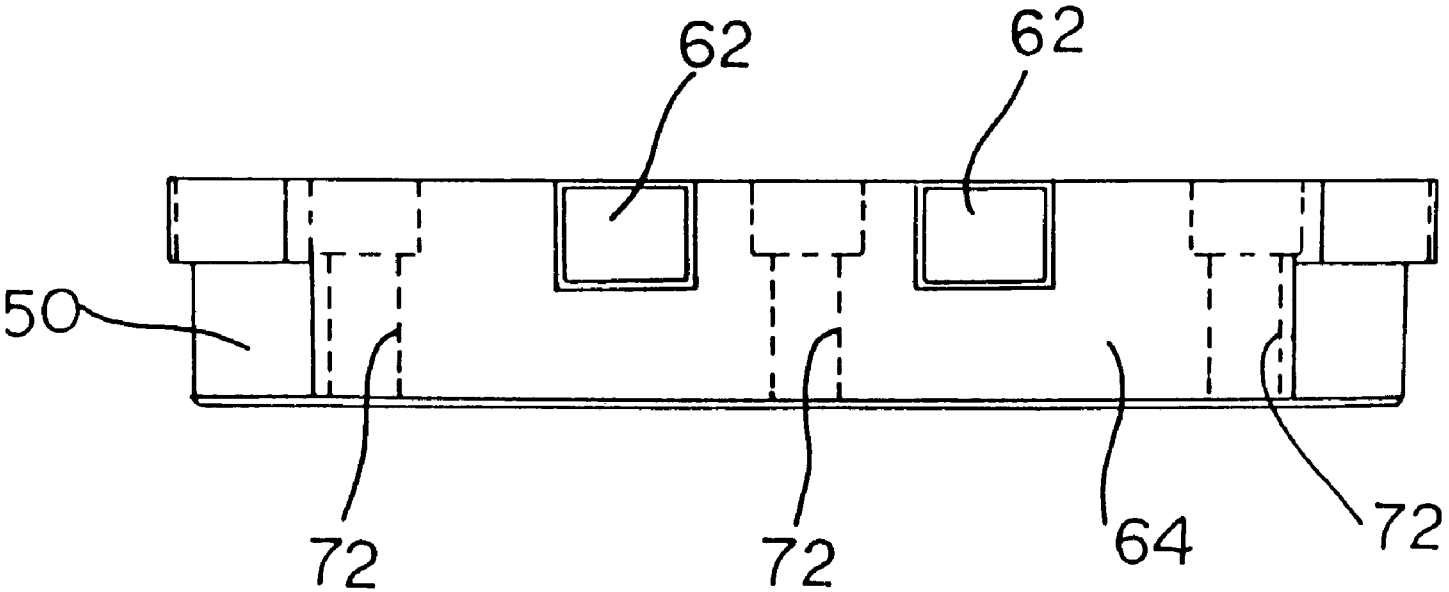
FIG. 8 is a top plan view of the adaptor plate in accordance with a preferred embodiment of the present invention.

The adaptor plate 50 includes flanged extensions 56 that engage slotted channels 58 formed within the cavity 44 of the shank 26 (FIG. 3). The engagement of the extensions 56 into the channels 58 securely engage the die assembly 30 with the shank 26. To secure the die assembly 30 to the shank 26, a cam plate 60 is secured using threaded fasteners in a relief 37 formed in the front face 36 of the shank 26 (FIG. 2). As will be appreciated, the die assembly 30 may be removed simply be sliding it relative to the shank 26. As can be seen in FIGS. 5 and 8, the adaptor plate 50 is formed with a pair of bosses 62 extending from a top surface 64 thereof. When secured to the shank 26 with the die assembly 30 positioned within the shank 26, the cam plate 60 bears against the bosses 62 to ensure that the die assembly 30 is securely retained within the shank 26.

Figure 7:
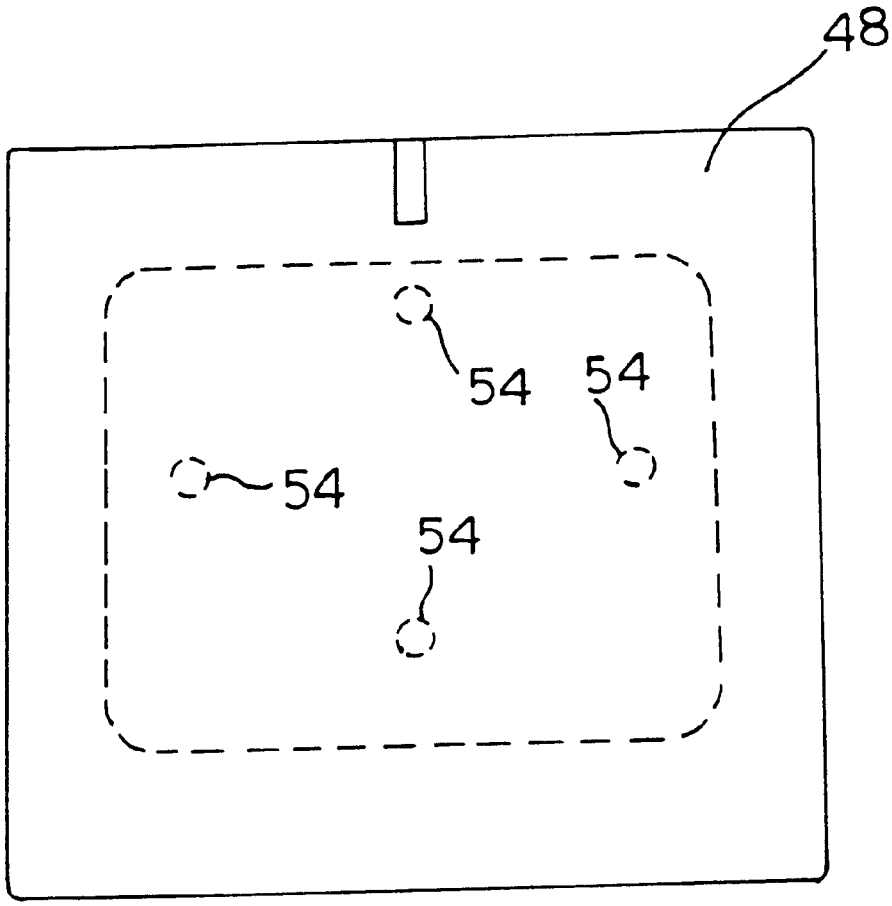
FIG. 7 is a side view of the die shown in FIG. 6.
Figure 9:
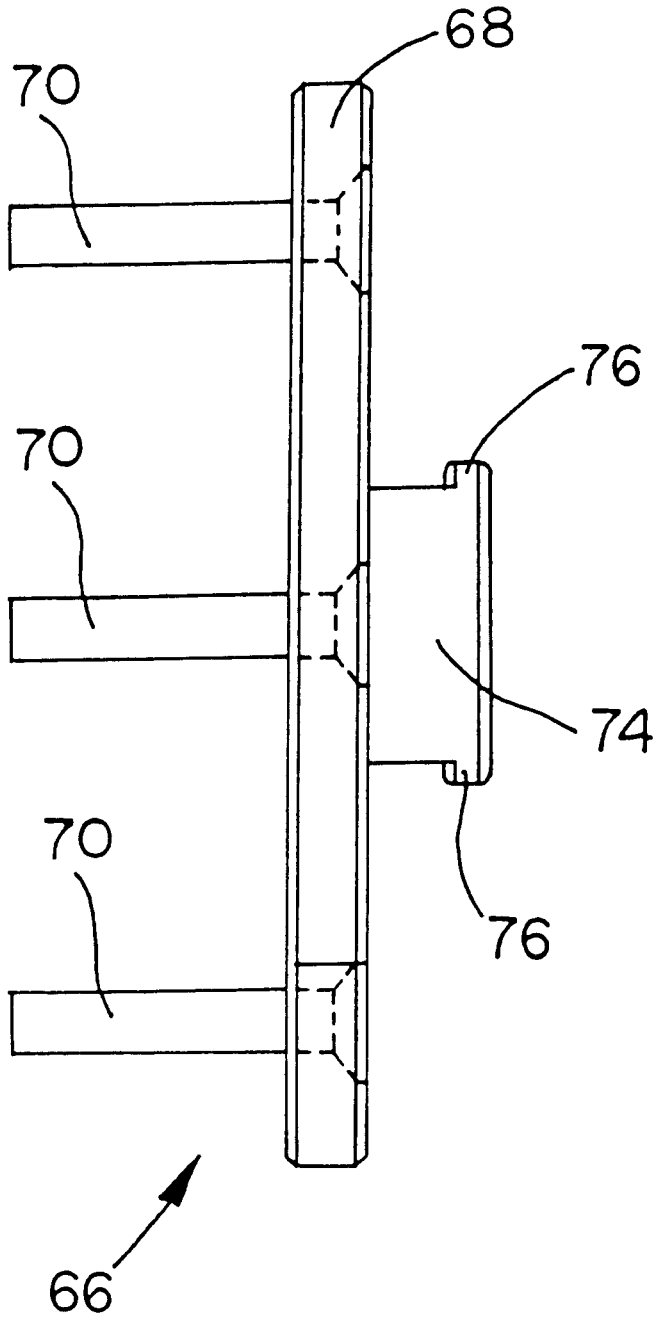
FIG. 9 is a front view of an ejector plate assembly in accordance with a preferred embodiment of the invention.
Figure 10:
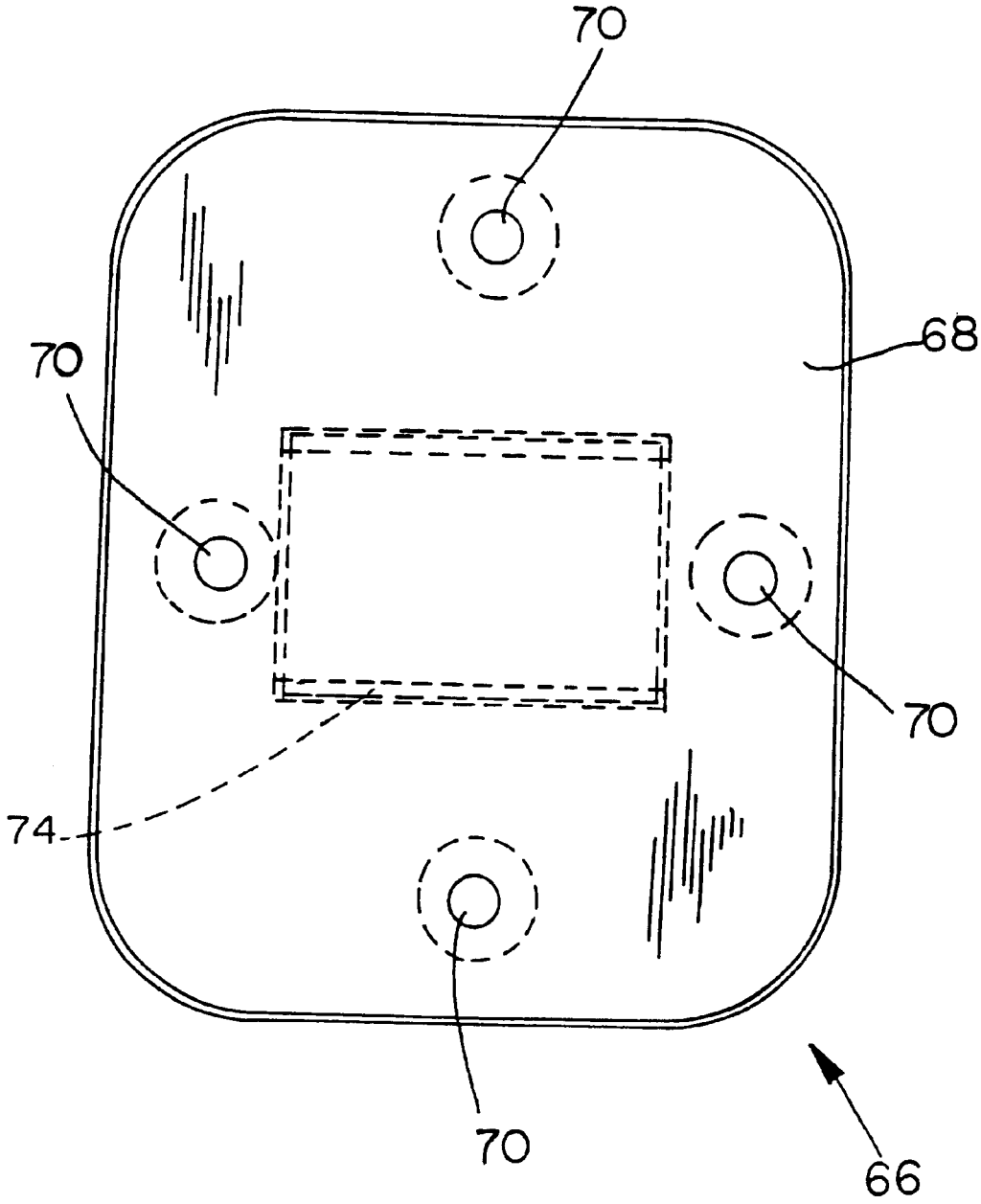
FIG. 10 is a side view of the ejector plate assembly illustrated in FIG. 9.
Figure 11:
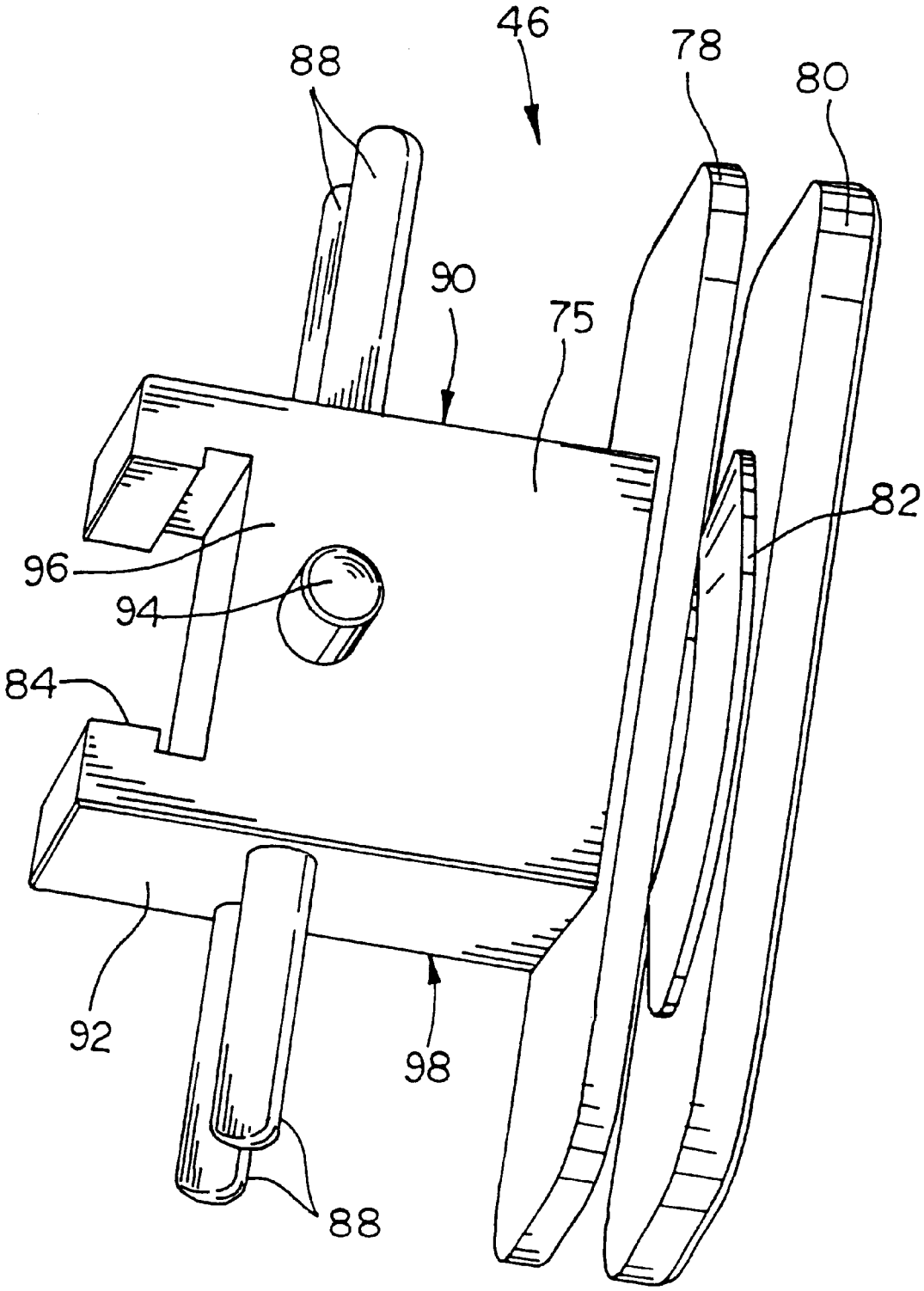
FIG. 11 is a perspective view of a spool in accordance with a preferred embodiment of the present invention.

When a part is formed, it is necessary to eject the formed part from the die member 48. This is accomplished by providing ejector pins that extend through apertures 54 formed in the die 50 and into the mold portion 53. In accordance with the preferred embodiments of the invention, and with reference to FIGS. 9–10, the die assembly 30 further includes an ejector plate assembly 66. The ejector plate assembly 66 includes a ejector plate base 68 into which are secured a plurality of ejector pins 70, extending substantially perpendicularly from the ejector plate base 68. When the ejector plate assembly 66 is coupled with the die assembly 30, the ejector pins 70 slidingly extend through apertures 72 (FIG. 8) formed in the adaptor plate 50 and apertures 54 (FIGS. 6 and 7) formed in the die 48. As will be described, when the various die assemblies 30 of the die casting machine are brought together during operation to form a complete mold, the ejector pins 70 are withdrawn from the mold portion 53. Then, when the die assemblies 30 are separated after a die cast has been formed, the ejector pins 70 are inserted into the die 48 and extend into the mold portion 53 to eject the molded die cast from the die 48. A hub 74 extends from the ejector plate base 68 opposite the ejector pins 70. The hub 74 has two opposing flanges 76 for engaging the spool 46. (FIG. 11) Referring particularly to FIG. 11, spool 46 includes a hub 75, a first piston plate 78 and a second piston plate 80, each secured to the hub 75, and each being spaced from one another by an offset portion 82 formed on the second piston plate 80. Hub 75 is formed to include a "T" shaped slot 84 into which the flanges 76 are received for engaging the ejector plate assembly 66 with the spool 46.

The spool 46 is housed within the shank 26, and in accordance with the invention, remains within the shank 26 during the changing of a die assembly 30. As the die assembly 30 is separated from the shank 26, by sliding it from the shank 26 during a change of the die assembly 30, the ejector plate assembly 66 disengages from the spool 46, i.e., the flanges 76 disengage from the slot 84.

During operation of the die casting machine 10, the spool 46 remains stationary within the shank 26 relative to the die casting machine 10 during displacement of the shank 26, i.e., during closing and opening of the die assemblies 30. A cam (not shown) extends from the die casting machine 10 and through a slot 86 formed in the shank 26 (FIGS. 2 and 3) engaging the spool 46 between the first and second piston plates 78 and 80.

The first and second piston plates 78 and 80 are sized to be slidingly received within the chamber 44 of the shank 26. In a preferred embodiment, two pins 88 extend outwardly, in opposing direction, from the top side 90 and bottom side 92 the hub 75 and a single pin 94 extends outwardly, in opposing directions, from the front side 96 and the back side 98 of the hub 75. While six pins are described, one will appreciate that fewer or more pins may be used for this purpose.

In accordance with the invention, a plurality of die assemblies, each adapted for the production of different part or parts, may be constructed. Each die assembly in accordance with the invention includes a die member, adaptor plate and an ejector plate assembly. The die assemblies may be further adapted for the connection of cooling lines, production automation, and the like. The die assemblies may be quickly and easily changed by first disconnecting any attached cooling lines, production automation or the like. Next, the cam plates are removed freeing the die assemblies from their associated shanks. Replacement die assemblies may then be secured to the shanks. In doing so, the spools are engaged with the respective ejector plate assembly, and the die assemblies are secured using the cam plates. The accessory items, such as cooling lines, are reconnected and any final machine adjustments completed. Preferably, the die, adaptor plate and associated ejector plate assembly may be sized so as to provide a standardized die assembly so as to minimize adjustments to the die casting machine. That is, by providing substantially commonized die assemblies, adjustments to the die casting machine, such as die closing force, may be minimized.

The present invention has been described in terms of several preferred embodiments, each of which are intended to illustrate the principles of the present invention. One of ordinary skill in the art will appreciate that invention may be otherwise embodied without departing from the scope and spirit of the invention set forth in the subjoined claims.

We claim:

1. A method of coupling a die with a die casting machine, wherein the die casting machine includes a shank portion having a front face, a rear face, a top portion and a bottom portion defining a cavity and a spool operatively disposed within the cavity, the method comprising:

providing die, the die including a mold portion;

operatively coupling an adaptor plate to a surface of the die to form a die assembly;

providing an ejector plate, and operatively coupling the ejector plate to the die assembly;

securing the die assembly to the shank while substantially simultaneously operatively coupling the ejector plate to the spool.

2. The method of claim 1, wherein the adaptor plate is formed with an aperture and the ejector plate is formed with an ejector pin, and the step of operatively coupling the ejector plate to the die assembly comprise slideably receiving the ejector pin within the adaptor plate aperture.

3. The method of claim 1, wherein the spool is formed with a slot and the ejector plate is formed with a flange and the step of operatively coupling the ejector plate to the spool comprises slideably receiving the flange within the ejector plate slot.

4. A The method of claim 1, comprising providing a cam plate and wherein the step of securing the die assembly to the shank comprises securing the cam plate to the shank.

5. The method of claim 4, wherein the adaptor plate is formed to include a boss, the cam plate being arranged to bear against the boss to secure the die assembly to the shank.

6. The method of claim 1, wherein the adaptor plate is formed to include a flange extension and the shank is formed to include a slotted channel, and wherein the step of securing the die assembly to the shank comprises slideably receiving the flange extension within the slotted channel.

7. The method of claim 1, comprising fixing the spool to the die casting machine such that it is held in position relative to cycling motion of the shank during operation of the die casting machine.

8. A method of coupling a die with a die casting machine, wherein the die casting machine includes a shank portion, the shank defining a cavity, and a spool operatively disposed within the cavity, the method comprising:

providing the shank with a die assembly interface, the die assembly interface adapted to couple to a die assembly and having a die assembly receiving formation of a predetermined dimension, providing a die assembly with a shank interface and an ejector assembly, the shank interface adapted to couple to the shank at the die assembly interface, and the die assembly interface having a shank assembly engaging formation, the shank assembly engaging formation having a complimentary configuration to the die assembly receiving formation, and securing the die assembly to the shank by engaging the shank engaging formation with the die assembly receiving formation and operatively coupling the ejector assembly to the spool.

9. The method of claim 8, wherein the step of providing a die assembly with a shank interface comprises providing a plurality of die assemblies having the shank interface, and the step of securing the die assembly to the shank comprises securing one of the plurality of die assemblies to the shank.

10. The method of claim 9, wherein:

the die assembly includes a die having a mold portion and an adaptor plate, the ejector assembly includes an ejector plate and the shank assembly engaging formation comprises a first flange formed on the adaptor plate and a second flange formed on the ejector plate, the die assembly engaging formation comprises a first slot formed in the shank and a second slot formed in the spool, and the step of securing the die assembly to the shank comprises slideably receiving the first flange within the first slot and the second flange within the second slot.

11. The method of claim 8, comprising providing a cam member for securing the die assembly to the shank.

12. A die assembly for use with in method of claim 8.

* * * * *